United States Patent [19]

Pope et al.

[11] Patent Number: 4,618,744

[45] Date of Patent: Oct. 21, 1986

[54] ROCKER KEY ELASTOMER DOME KEYBOARD

[75] Inventors: Kent M. Pope; Bryan L. Hardesty, both of Coeur d'Alene, Id.

[73] Assignee: Advanced Input Devices, Inc., Coeur d'Alene, Id.

[21] Appl. No.: 728,231

[22] Filed: Apr. 29, 1985

[51] Int. Cl.[4] ..... H01H 13/70

[52] U.S. Cl. ..... 200/5 A; 200/159 B; 200/339

[58] Field of Search ..... 200/5 A, 5 R, 159 B, 200/275, 339, 340, 67 DA, 67 DB

[56] References Cited

U.S. PATENT DOCUMENTS

| | | | |
|---|---|---|---|
| 3,800,104 | 3/1974 | Lien et al. | 200/5 A |
| 3,916,135 | 10/1975 | Holden et al. | 200/159 B X |
| 4,095,059 | 6/1978 | Nishioka et al. | 200/5 B |
| 4,096,364 | 6/1978 | Lynn et al. | 200/5 A |
| 4,314,112 | 2/1982 | Misson et al. | 200/5 A |
| 4,351,988 | 9/1982 | Allbright | 200/159 B X |
| 4,352,964 | 10/1982 | English | 200/5 A |
| 4,378,478 | 3/1983 | Deeg | 200/159 B |
| 4,390,765 | 6/1983 | Sado et al. | 200/159 B |
| 4,430,531 | 2/1984 | Wright | 200/5 A |
| 4,493,959 | 1/1985 | Viebrantz | 200/159 B X |

FOREIGN PATENT DOCUMENTS 2058462A 4/1981 United Kingdom ..... 200/159 B

OTHER PUBLICATIONS

IBM Tech. Disc. Bull.; D. L. Pierson, "Sloped Key Button", vol. 19, No. 3, 8-1976, pp. 1035, 1036.

*Primary Examiner*—J. R. Scott

*Attorney, Agent, or Firm*—Christensen, O'Connor, Johnson & Kindness

[57] ABSTRACT

A keyboard including an elastomer dome keypad (15) and rocker mounted keys (25) positioned to acutate the domes (17) of the keypad (15) is disclosed. The rocker action keys (25) include outwardly extending flanges (29) that include apertures (49, 51) positioned to receive protrusions (33) that extend downwardly along the edge of the bezel apertures (23) in which each key (25) is to be positioned. The bezel (21) is positioned such that each key aperture (23) and, thus, each key (25) overlies the dome (17) of the elastomer dome keypad (15) that the key (25) is to actuate. The dome contacting region of the keys (25) is a pair of curved webs (53, 55). The curved webs apply a broad steady orthogonal force to the top of the underlying dome causing the dome to collapse in an even, positive manner even though the keys follow an arcuate path of travel.

19 Claims, 8 Drawing Figures

ROCKER KEY ELASTOMER DOME KEYBOARD

TECHNICAL AREA

This invention relates to keyboards for electronic equipment and, more particularly, to keyboards that include elastomer dome keypads.

BACKGROUND OF THE INVENTION

Keyboards are used as the communication medium between electronic equipment and the user of the equipment. Keyboards allow the user to manually input data and/or command electronic equipment to function in a particular manner. The most widely used modern keyboards come in two general varieties. One variety is flat and the keys are selected regions of an overlay. When pressure is applied to a "key" overlay region, a switch mechanism located beneath the overlay region is actuated. Actuation of the switch is detected by the associated electronic equipment and causes the equipment to function in a particular manner. The other variety of modern keyboards includes discrete key elements mounted in or surrounded by a bezel—a plate having holes through which the key elements pass. The depression of a key element causes the actuation of an underlying switch mechanism, which is detected by the associated electronic equipment. The present invention is directed to discrete key element keyboards, which are sometimes referred to as "full throw" keyboards by virtue of the fact that the travel distance of the discrete key elements is substantially greater than the travel distance of the key overlay regions of flat keyboards.

Discrete keyboards can be broken into two general types—those in which the keys have a straight up-down path of travel, and those in which the keys have an arcuate path of travel. Arcuate path of travel keys are hinged along one edge in some manner. Regardless of their path of travel, both types of keys move an underlying element when they are depressed. The underlying element makes contact with one or more further elements to "close" a switch.

In many prior keyboards, the movable underlying element actuated when a key is depressed is a metal dome that collapses when impacted by a sharp point formed on the underside of the depressed key. More recently, the metal dome "keypads" used in some keyboards have been replaced with elastomer dome keypads, which are considerably less expensive to produce. Elastomer dome keypads include a layer of elastomeric material having domes located at predetermined positions. Locationed in the center of the domes is a piece of conducting elastomer. Collapsing a dome causes the conducting elastomer to contact switch elements formed on the surface of an underlying printed wire board.

Prior to the present invention, elastomer dome keypads have been primarily used in keyboards in which the keys have a straight up-down path of travel. Elastomer dome keypads have not been used in keyboards in which the keys have an arcuate path of travel. Thus, the lower cost benefits resulting from the use of elastomer dome keypads have not been implemented in arcuate or "rocker" type keyboards.

The primary reason why elastomer dome keyboards have not been implemented in rocker-type keyboards is due to the fact that the arcuate path of travel followed by the keys of such keyboards does not allow an elastomer dome keypad to be readily substituted for a metal dome keypad, as has been the case with straight up-down path of travel keyboards. The reason why elastomer dome keypads cannot be readily substituted for metal dome keypads in rocker-type keybaords is due to the fact that the domes of elastomer dome keypads collapse in an entirely different manner than the metal domes of a metal dome keypad. Straight up-down movement presses a large flat surface against an elastomer dome which is the ideal way of collapsing the center region of an elastomer dome and creating positive contact between the conductive elastomer and the underlying switch elements. An arcuate path of travel tends to collapse one side rather than the center region of an elastomer dome resulting in less than ideal contact between the conductive elastomer and the underlying switch elements.

Another disadvantage of prior rocker-type keyboards including metal dome keypads is the complexity of the rocker mounting structure. More specifically, metal dome keypads, as compared to elastomer dome keypads, require high actuation force from the keys. As a result, a relatively rugged key mounting structure is required. One common mounting mechanism involves hinging the rocker-type keys on wire guides mounted on standoffs affixed to the printed wire board containing the switch elements that are contacted when a metal dome is collapsed. Since rods and standoffs are expensive, the cost of keyboards using such mechanisms is undesirably high. Further, unacceptably high numbers of breakage problems occur where the key grabs the rod. Also assembly time is high because keys must be attached to the hinge rods before other portions of the keyboard are assembled. Finally, the rods and standoffs require a significant amount of room, which makes the distance between keys greater than desirable.

This invention is directed to providing rocker key elastomer dome keyboards that are inexpensive to produce and avoid the cost and other disadvantages of rocker-type keyboards that employ metal dome keypads.

SUMMARY OF THE INVENTION

In accordance with this invention, a keyboard including an elastomer dome keypad and rocker mounted keys for depressing the domes of the keypad is provided. Extending outwardly from one side of each key is a flange that includes holes positioned to receive protrusions that extend downwardly along the edge of the bezel aperture in which the key is to be mounted. The holes and the protrusions create a hinge-like point. The bezel is positioned such that each key aperture and, thus, each key, overlies the dome of an elastomer dome keypad that the key is to depress. The domes function to hold the keys in position by creating a pressure against the keys that prevents the bracket holes from slipping off of the protrusions. The part of the keys that impinge on and depress the underlying domes are formed such that key depression applies a broad steady pressure against the underlying dome that results in the center region of the dome collapsing in an even positive manner.

In accordance with other aspects of this invention, the part of the keys that impinges on the domes of the elastomer dome keypad is formed by the edges of two webs that apply pressure to the center of the domes when the related key is depressed. Preferably, the impinging region of the webs that applies pressure to the domes when the related key is depressed is curved.

In accordance with further aspects of this invention, the flange that extends outwardly from the side of each key includes two holes. Each hole receives a protrusion that extends downwardly along the edge of the bezel aperture in which the key is to be mounted.

In accordance with alternative aspects of this invention, rather than dome pressure forming the entire mechanism for retaining the keys in position, the brackets are latched in position by arms located adjacent to the protrusions. The arms include extensions that lie beneath the protrusions and prevent the bracket holes from slipping off of the protrusions regardless of the presence of dome pressure.

As will readily be appreciated from the foregoing description, the invention provides rocker-type keyboards that include keys configured to apply the type of broad, steady pressure to the tops of the domes of elastomer dome keypads needed to collapse the center regions of the domes in an even positive manner. Since the key mounting structure is uncomplicated, it's inexpensive. Not only is the key mounting structure inexpensive to produce, keyboard assembly is inexpensive. Further keyboards formed in accordance with the invention are highly reliable and subject to minimal breakage during assembly. Hence, the invention provides inexpensive, highly reliable, rocker-type keyboards that include inexpensive elastomer dome keyboards.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein.

DESCRIPTION OF THE PREFERRED EMBODIMENT

Figure 1:
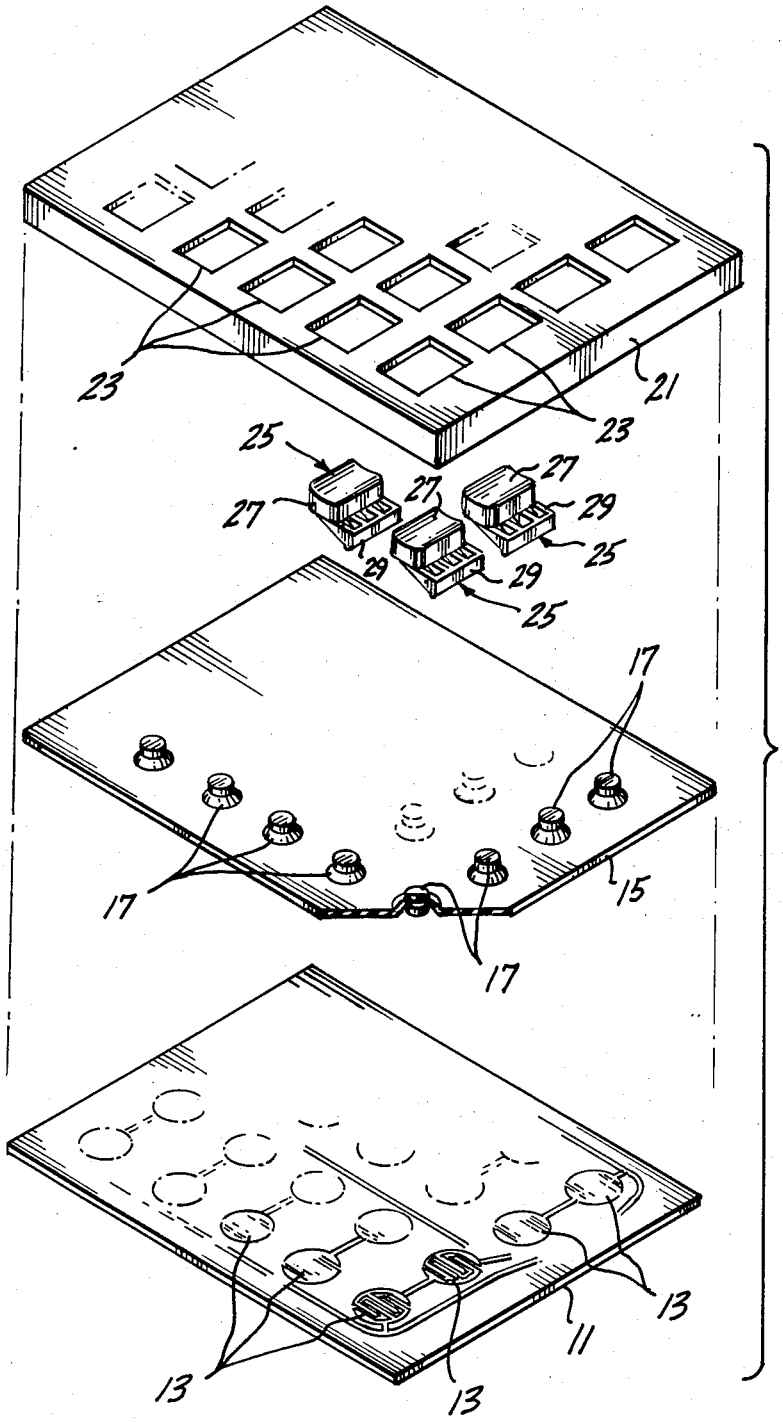
FIG. 1 is an exploded, pictorial view of a rocker key elastomer dome keyboard formed in accordance with the invention.
Figure 2:
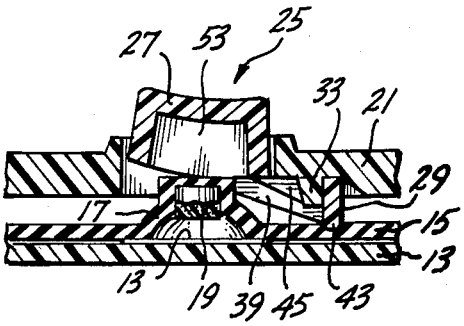
FIG. 2 is a cross-sectional view of a key and the underlying elastomer dome region of the keyboard illustrated in FIG. 1.

FIG. 1 illustrates a rocker key elastomer dome keyboard formed in accordance with the invention, which includes a printed wire board (PWB) 11 having a plurality of switch contact areas 13 arrayed on one surface. Overlying the PWB 11 is an elastomer dome keypad 15. The elastomer dome keypad 15 includes a plurality of domes 17, each of which is positioned to overlie one of the switch contact areas 13 of the PWB 11 when the elastomer dome keypad 15 is suitably positioned atop the PWB 11. The main portion of the elastomer dome keypad 15, including the domes 17, is formed of a layer of nonconducting elastomer. As illustrated in FIG. 2, mounted in the center of each of the domes 17 is a button shaped piece of electrically conducting elastomer 19. As a result, when the domes 17 are collapsed in the manner hereinafter described contact is made between the underlying conductors via the piece of electrically conducting elastomer 19 mounted in the collapsed dome.

Overlying the elastomer dome keypad 15 is a bezel 21 that includes a plurality of rectangular apertures or holes 23. The apertures 23 are positioned such that one aperture 23 lies above each of the domes 17 when the bezel 21 is suitably positioned above the elastomer dome keypad 15. Also illustrated in FIG. 1 are a plurality of keys 25. Each key includes a rectangular button portion 27 and a flange 29 that extends outwardly from one side of the button portion. The button portions 27 of the keys 25 are sized to pass through the apertures 23 in the bezel 21.

Figure 3:
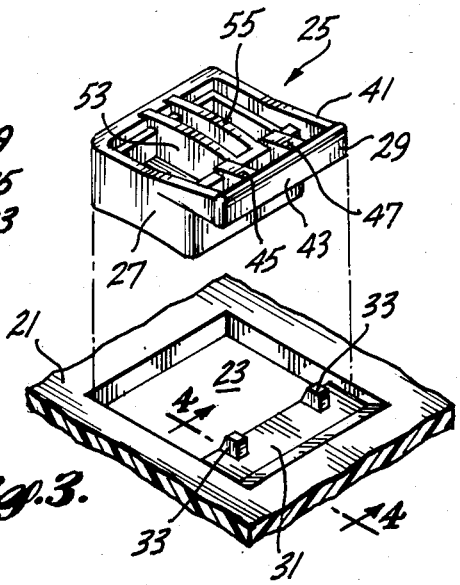
FIG. 3 is an inverted, exploded view of the mounting of a key in the keyboard illustrated in FIG. 1.
Figure 4:
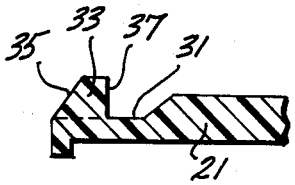
FIG. 4 is a cross-sectional view along line 4—4 of FIG. 3.
Figure 5:
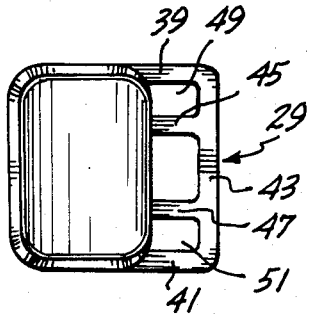
FIG. 5 is a top view of a key suitable for use in the keyboard illustrated in FIG. 1.
Figure 6:
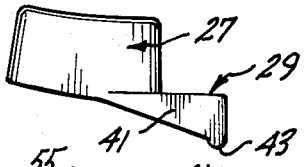
FIG. 6 is a side view of the key illustrated in FIG. 5.

As best illustrated in FIGS. 3 and 4, an undercut region 31 is formed in the lower surface of the bezel 21 along one edge of each rectangular aperture 23. Located in the undercut region 31 immediately adjacent the edge of the aperture 23 are two protrusions 33 that are integrally formed with the main part of the bezel. The protrusions are ramp-shaped with the inclined edge 35 of the ramps beginning at the edge of the undercut region 31 adjacent the rectangular aperture 23 and tapering away from the aperture. The edge 37 of the protrusions opposed to the inclined edge 35 lies orthogonal to the base of the undercut region 31.

The flanges 29 of each key 25 include a pair of outer sidewalls 39 and 41 that extend outwardly from opposed sides of the button portion 27 of the key. The outer sidewalls have a right triangular configuration when viewed from the side. One of the acute angles of the sidewalls is integrally formed with the button 27 and the right angle lies above the other acute angle at the outer ends of the outer sidewalls 39 and 41. Extending across the outer ends of the outer sidewalls 39 and 41 is an enclosing endwall 43 that is integrally formed with the outer sidewalls. Thus, the outer sidewalls 39 and 41 and the endwall 43 form an open frame.

Located inwardly of the outer sidewalls and lying parallel thereto are a pair of inner sidewalls 45 and 47. The inner sidewalls are integrally formed with the endwall 43 and the button portion 27 and extend therebetween. Like the outer sidewalls 39 and 41, the inner sidewalls 45 and 47 are right triangularly shaped (albeit smaller) when viewed from the side. One of the acute angles of the inner sidewalls is integrally formed with the bottom of the side of the button portion from which the flange 29 extends. The opposed edge of the inner sidewalls 45 and 47 is integrally formed with the endwall 43. As a result, the flange 29 defines a pair of outer apertures 49 and 51, each lying between an outer sidewall and an inner sidewall. The outer apertures 49 and 51 are sized to receive the protrusions 33 formed in the undercut regions 31 of the bezel 21. The combination of the protrusions 33 and the outer apertures 49 and 51 form a hinge-like mechanism.

The button portion 27 of the keys 25 is hollow and includes a pair of webs 53 and 55. The webs 53 and 55 define planes that lie parallel to the planes defined by the outer sidewalls 39 and 41 and the inner sidewalls 45 and 47. The lower edges of the webs 53 and 55 impinge on and collapse the underlying dome 17 when a key 25 is depressed. The lower edges of the webs 53 and 55 are flat in the region between the midpoint of the button portion 27 and the edge of the button portion from which the flange 29 extends. The remaining portion of the lower edges of the webs 53 and 55 are curved. The curvature is such that the curved web edges diverge from the top of the underlying dome, as best seen in FIG. 2. The radius of curvature is relatively large. As a result, a large area depression force is continuously applied to the center of the underlying dome when a key is depressed. The curvature causes the depression force to remain generally orthogonal to the top of the dome, rather than changing to a side force, as would be the case with flat lower edge webs.

There are a number of advantages to a rocker key elastomer dome keyboard of the type illustrated in FIGS. 1–7 and heretofore described. The use of two protrusion/hole combinations located on opposite sides of the flange 29 substantially limits key skewing. In this regard, while two protrusions are preferred, obviously a single protrusion/hole combination could be utilized if desired. Depending upon the size of a single protrusion/hole combination, more or less key skewing, i.e., side movement, will occur. Another advantage of a keyboard formed in the manner illustrated in FIGS. 1–7, is that the keys can be installed after the main elements of the keyboard are assembled. That is, the PWB 11, elastomer dome keypad 15 and the bezel 21 can be assembled prior to the insertion of the keys. After the main elements are assembled the keys are installed by sliding the flange 29 of the keys through the rectangular apertures in the bezel so that the flanges slide over the ramp side of the protrusions 33 until the protrusions align with the outer apertures 49 and 51 in the flanges. During insertion the underlying elastomer dome will collapse. After the protrusions 33 enter the outer apertures 49 and 51, the collapsed dome will expand and return to its quiescent expanded configuraton. In the expanded configuration the domes press against the webs 53 and 55 and hold the keys in the unactuated position illustrated in FIG. 2.

Figure 8:
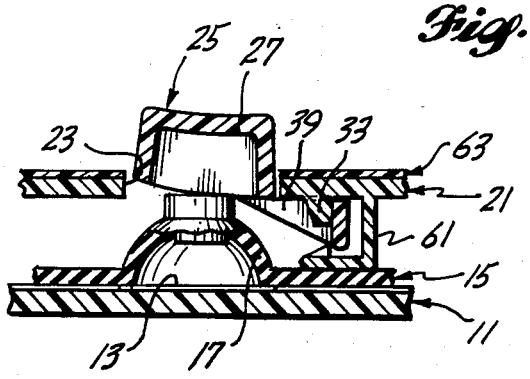
FIG. 8 is a cross-sectional view of a modification of the key mounting arrangement of the embodiment of the invention illustrated in FIGS. 1–7.
Figure 7:
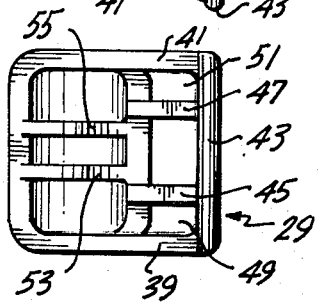
FIG. 7 is a bottom view of the key illustrated in FIG. 5.

As will be readily appreciated from the foregoing description, keys 25 of the elastomer dome keyboard illustrated in FIGS. 1–7 are held in position solely by the pressure created by the resiliency of the domes 17. As a result, when the keyboard is disassembled, the keys can separate from the bezel. FIG. 8 illustrates a structural modification that attaches the keys 25 to the bezel and prevents such separation. More specifically, FIG. 8 illustrates a keyboard of the type illustrated in FIGS. 1–7 to which has been added flange trapping arms 61. The flange trapping arms 61 are integrally formed with the bezel 21 and extend downwardly therefrom adjacent to, but spaced from, the protrusions 33. The trapping arms 61 have an L-shaped configuration when viewed in cross section. One of the L-shaped arms is integral with the bezel and the other underlies the protrusion. Thus, the trapping arms 61 trap the outer wall 43 of the flanges 29 of the keys 25. Preferably, as noted above, the trapping arms 61 are integrally molded with the bezel 21. As a result, depressions in the regions of the trapping arms 21 form in the top of the bezel 21. FIG. 8 also illustrates a covering plate 63 positioned atop the bezel 21 to cover these depressions.

As will be readily appreciated from the foregoing description, the invention provides a rocker key elastomer dome keyboard that is inexpensive to manufacture and assemble. In addition, the rocker key elastomer dome keyboard provides a key that is ideally suited for actuating the domes of elastomer dome keypads.

While a preferred embodiment of the invention has been illustrated and described, it will be appreciate that various changes can be made therein without departing from the spirit and scope of the invention. Consequently, the invention can be practiced otherwise than as specifically described herein.

The embodiments of the invention in which an exclusive property or privilege is claimed are defined as follows:

1. A rocker key elastomer dome keyboard comprising:

a printed wire board having an array of spaced apart switch contacts located on one surface;

an elastomer dome keypad positioned so as to overlay the surface of said printed wire board on which said array of spaced apart switch contacts are located, said elastomer dome keypad formed of a layer of elastomeric material having a plurality of domes formed in said layer, said domes being aligned with said array of spaced apart switch contacts, said domes including conducting means positioned such that the collapsing of said domes results in said conducting means being brought into electrical contact with the spaced apart switch contacts aligned with said conducting means;

a bezel positioned so as to overlay said elastomer dome keypad on the side thereof remote from said printed wire board, said bezel including a plurality of apertures, said apertures aligned with said domes of said elastomer dome keypad;

a plurality of keys positioned in said apertures in said bezel such that said keys impinge on the tops of the domes aligned with said apertures in said bezel, the region of said keys that impinge on said domes formed so as to apply a collapsing force to the center of said dome that causes the center of said domes to collapse in an even, positive manner when the keys follow an arcuate path of travel, each of said keys including a button portion and a flange portion, said button portions passing through said apertures in said bezel; and, rotary mounting means for attaching said keys to said bezel such that the path of travel of said keys is arcuate, said rotary mounting means comprising two spaced apart apertures formed in the flange of each of said keys and two corresponding spaced apart protrusions, one aligned with each of said apertures in said flange, extending outwardly from said bezel on the side thereof facing said elastomer dome keypad.

2. A rocker key elastomer dome keyboard as claimed in claim 1 wherein said flanges of said keys are formed by a pair of outer sidewalls and an enclosing endwall that defines a frame.

3. A rocker key elastomer dome keyboard as claimed in claim 2 wherein said flanges also include inner sidewalls and wherein said pair of spaced apart apertures are formed by the region between said inner sidewalls and said outer sidewalls of said flanges.

4. A rocker key elastomer dome keyboard as claimed in claim 1 wherein said apertures in said bezel have a rectangular shape and wherein the button portions of said keys are rectangular and sized to fit in said apertures.

5. A rocker key elastomer dome keyboard as claimed in claim 4 wherein said flange extends outwardly from one side of said rectangular button portions of said keys.

6. A rocker key elastomer dome keyboard as claimed in claim 5 wherein said flanges of said keys are formed by a pair of outer sidewalls and an enclosing endwall that defines a frame.

7. A rocker key elastomer dome keyboard as claimed in claim 6 wherein said flanges also include inner sidewalls and wherein said pair of spaced apart apertures are formed by the region between said inner sidewalls and said outer sidewalls of said flanges.

8. A rocker key elastomer dome keyboard comprising:

a printed wire board having an array of spaced apart switch contacts located on one surface;

an elastomer dome keypad positioned so as to overlay the surface of said printed wire board on which said array of spaced apart switch contacts are located, said elastomer dome keypad formed of a layer of elastomeric material having a plurality of domes formed in said layer, said domes being aligned with said array of spaced apart switch contacts, said domes including conducting means positioned such that the collapsing of said domes results in said conducting means being brought into electrical contact with the spaced apart switch contacts aligned with said conducting means;

a bezel positioned so as to overlay said elastomer dome keypad on the side thereof remote from said printed wire board, said bezel including a plurality of apertures, said apertures aligned with said domes of said elastomer dome keypad;

a plurality of keys positioned in said apertures in said bezel such that said keys impinge on the tops of the domes aligned with said apertures in said bezel, the region of said keys that impinge on said domes formed so as to apply a collapsing force to the center of said dome that causes the center of said domes to collapse in an even, positive manner when the keys follow an arcuate path of travel, each of said keys including a button portion and a flange portion, said button portions being hollow and passing through said apertures in said bezel, said region of said keys that impinge on said domes being formed by a pair of webs that extend across the hollow area of said button portion of said keyboards; and, rotary mounting means for attaching said keys to said bezel such that the path of travel of said keys is arcuate.

9. A rocker key elastomer dome keyboard as claimed in claim 8 wherein said rotary mounting means comprises at least one aperture formed in the flange of each of said keys and a corresponding protrusion aligned with said aperture in said flange and extending outwardly from said bezel on the side thereof facing said elastomer dome keypad.

10. A rocker key elastomer dome keyboard as claimed in claim 9 wherein said rotary mounting means comprises two spaced apart apertures formed in the flange of each of said keys and two corresponding spaced apart protrusions, one aligned with each of said apertures in said flange, extending outwardly from said bezel on the side thereof facing said elastomer dome keypad.

11. A rocker key elastomer dome keyboard as claimed in claim 8 wherein said apertures in said bezel have a rectangular shape and wherein the button portions of said keys are rectangular and sized to fit in said apertures.

12. A rocker key elastomer dome keyboard as claimed in claim 11 wherein said flange extends outwardly from one side of said rectangular button portions of said keys.

13. A rocker key elastomer dome keyboard as claimed in claim 12 wherein said rotary mounting means comprises at least one aperture formed in the flange of each of said keys and a corresponding protrusion aligned with said aperture in said flange and extending outwardly from said bezel on the side thereof facing said elastomer dome keypad.

14. A rocker key elastomer dome keyboard as claimed in claim 13 wherein said rotary mounting means comprises two spaced apart apertures formed in the flange of each of said keys and two corresponding spaced apart protrusions, one aligned with each of said apertures in said flange, extending outwardly from said bezel on the side thereof facing said elastomer dome keypad.

15. A rocker key elastomer dome keyboard as claimed in claim 11 wherein the edges of said webs that impinge on said domes are flat between the region of impingement when said domes are expanded and the wall of said button portions from which said flange extends, the remaining portion of said webs being curved away from said dome in the plane of arcuate movement of said keys.

16. A rocker key elastomer dome keyboard as claimed in claim 15 wherein said flange extends outwardly from one side of said rectangular button portions of said keys.

17. A rocker key elastomer dome keyboard as claimed in claim 16 wherein said rotary mounting means comprises at least one aperture formed in the flange of each of said keys and a corresponding protrusion aligned with said aperture in said flange and extending outwardly from said bezel on the side thereof facing said elastomer dome keypad.

18. A rocker key elastomer dome keyboard as claimed in claim 17 wherein said rotary mounting means comprises two spaced apart apertures formed in the flange of each of said keys and two corresponding spaced apart protrusions, one aligned with each of said apertures in said flange, extending outwardly from said bezel on the side thereof facing said elastomer dome keypad.

19. A rocker key elastomer dome keyboard as claimed in claim 8 wherein the edges of said webs that impinge on said domes are flat between the region of impingement when said domes are expanded and the wall of said button portions from which said flange extends, the remaining portion of said webs being curved away from said dome in the plane of arcuate movement of said keys.

* * * * *